US005924931A

United States Patent [19]

Morrissey, III

[11] Patent Number: 5,924,931

[45] Date of Patent: Jul. 20, 1999

[54] BOWLING LANE PERSPECTIVE PATTERN

[75] Inventor: William T. Morrissey, III, Grand Rapids, Mich.

[73] Assignee: Brunswick Bowling & Billiards Corporation, Muskegon, Mich.

[21] Appl. No.: 09/005,213

[22] Filed: Jan. 9, 1998

[51] Int. Cl.[6] ..... A63D 1/04

[52] U.S. Cl. ..... 473/115; 473/117

[58] Field of Search ..... 473/115, 117; 428/204, 151, 105, 106

[56] References Cited

U.S. PATENT DOCUMENTS

| | | | |
|---|---|---|---|
| Re. 35,778 | 4/1998 | Stirling et al. | 473/115 |
| 2,037,259 | 4/1936 | Murphy et al. | 473/115 |
| 2,375,663 | 5/1945 | Kennedy | 473/115 |
| 4,406,456 | 9/1983 | Berry et al. | 473/117 |

*Primary Examiner*—William M. Pierce
*Attorney, Agent, or Firm*—Price, Heneveld, Cooper, DeWitt and Litton

[57] ABSTRACT

A bowling lane surface comprising a top cover layer hving a pattern of a plurality of elongated simulated boards side-by-side across the width of the lane, the simulated boards across the lane being of alternate light and dark shades, having a symmetrical V pattern of spaced range finders on selected ones of the simulated boards, positioned uniformly across the lane, on the first longitudinal portion of the lane, selected simulated boards, preferably those having the range finders thereon, being outlined by dark lines simulating joints, a plurality of dark elongated markings arranged on selected simulated boards in the second longitudinal portion of the lane.

30 Claims, 2 Drawing Sheets

BOWLING LANE PERSPECTIVE PATTERN

BACKGROUND OF THE INVENTION

This invention relates to bowling lanes, and particularly to the surface pattern of a bowling lane cover layer simulating wood boards.

Bowling lanes are typically of two main types, namely, wood lanes formed of a plurality of elongated boards which are connected side-by-side, or alternatively, an upper layer simulating wood boards mounted on an underlayer which may be a worn wood lane made of boards or some other structural support made, e.g., wood or other materials on which the cover surface layer is mounted.

A bowling lane is typically 60 feet long from the foul line to the pin deck and, if made of wood, has 39 boards from side to side in the lane. At least portions of the lane are typically formed of maple wood.

SUMMARY OF THE INVENTION

An object of this invention is to provide a novel bowling lane with cover layer, and the cover layer therefor, having a particular pattern which gives an excellent unique visual effect of individual boards while providing the bowler with a perspective of image and depth. The novel pattern enables most effective use of range finders and cherries typically found on the first longitudinal half of the bowling lanes, with dark lines simulating junctions between selected ones of the simulated boards, preferably those having the range finders thereon, and down lane markings of a nature to help achieve image and depth perspective. The range finders are in a typical V pattern on selected ones of the simulated boards. The simulated boards are of alternate light and dark shades across the width of the lane. A plurality of dark elongated markings are symmetrically arranged in a special manner down lane on certain ones of the selected simulated boards and most preferably on those having the range finders thereon.

These and other features, advantages and objects of the present invention will be further understood and appreciated by those skilled in the art by reference to the following specification, claims and appended drawings.

DETAILED DESCRIPTION OF PREFERRED EMBODIMENT

Figure 4:
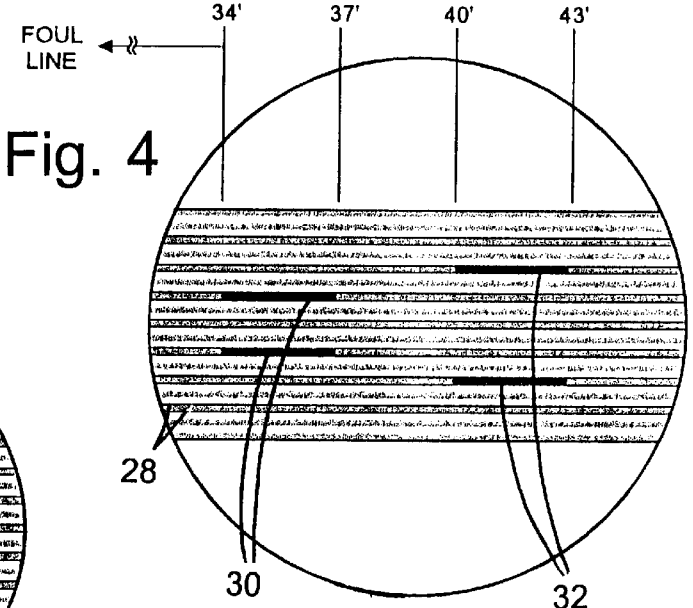
FIG. 4 is a somewhat enlarged view of a third portion of the lane having the down lane markings.
Figure 3:
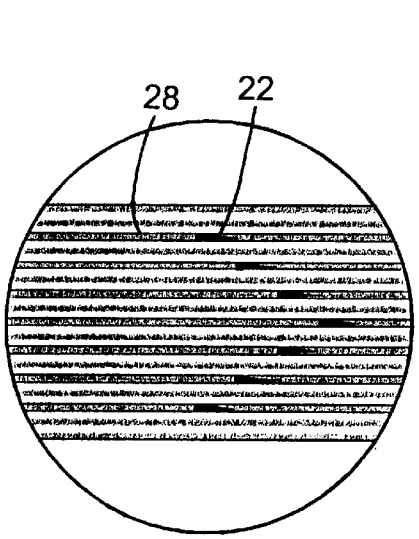
FIG. 3 is a somewhat enlarged plan view of another portion of the lane at the range finders.
Figure 2:
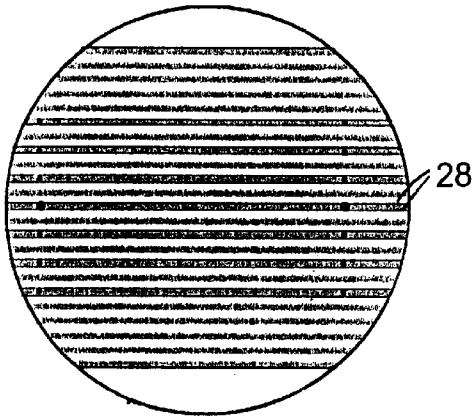
FIG. 2 is a somewhat enlarged plan view of a portion of FIG. 1 at the approach.
Figure 1:
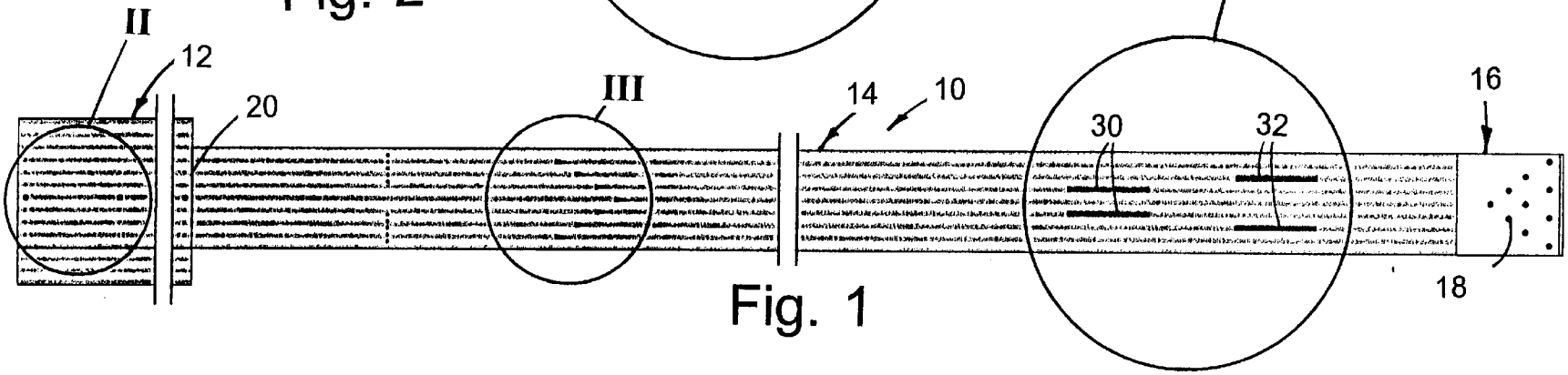
FIG. 1 constitutes a plan view of a computer simulated lane according to this invention.
Figure 5:
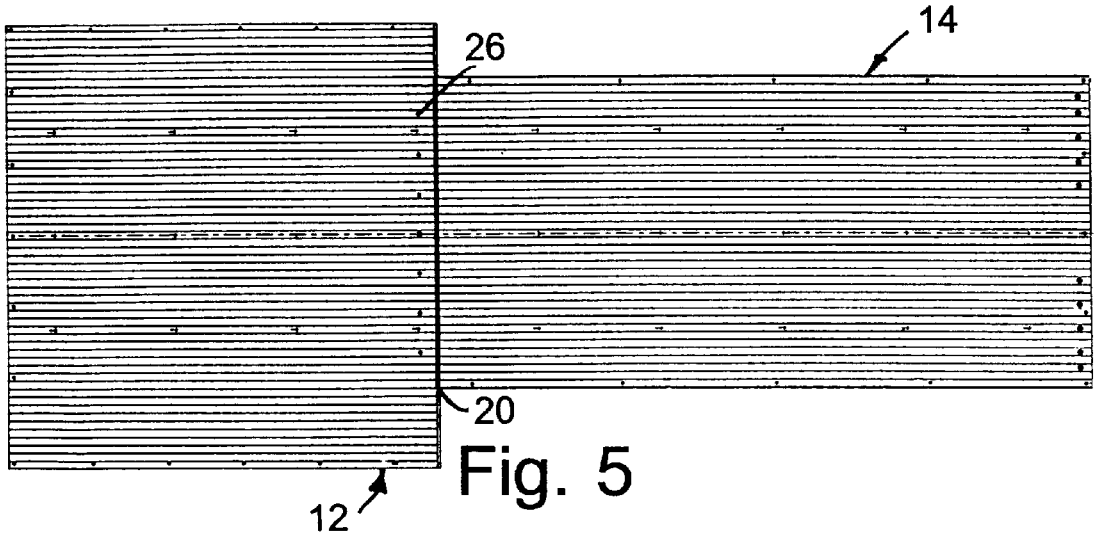
FIG. 5 is a plan view of the approach and the adjacent segment of the lane, showing the correct number of lane boards and the location of the first set of cherries.
Figure 7:
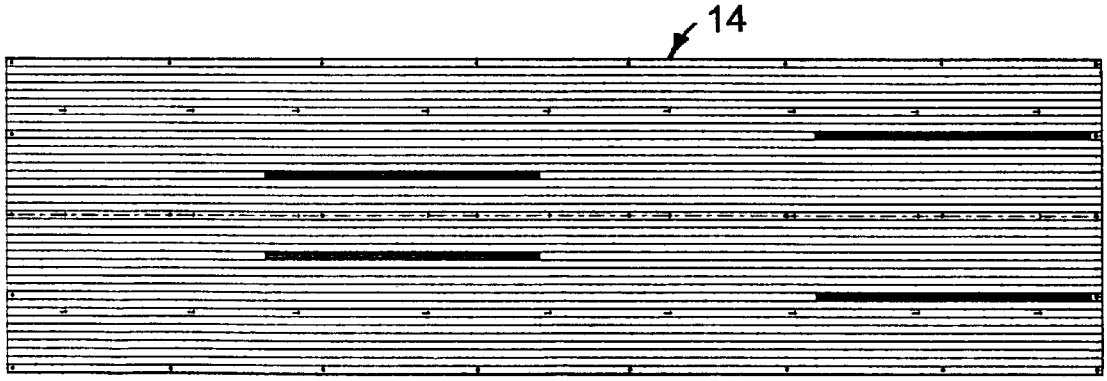
FIG. 7 is a plan view of a segment of the lane showing the down lane, dark elongated markings.
Figure 6:
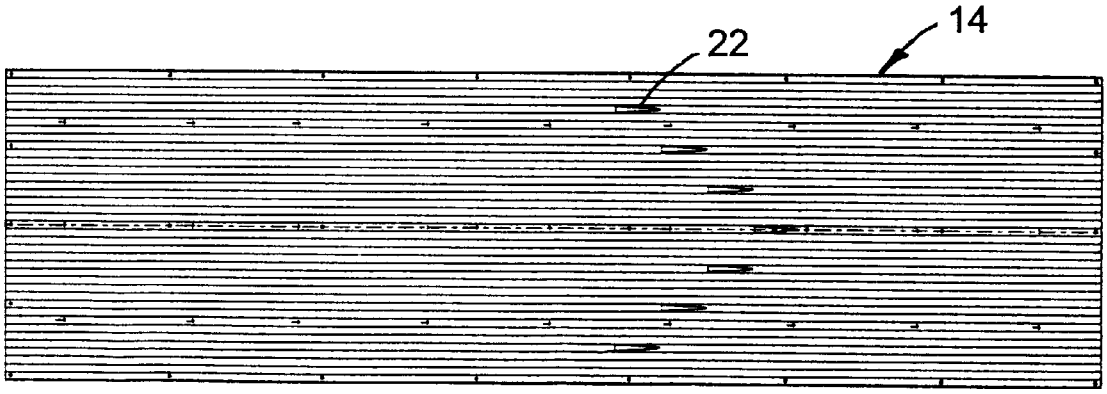
FIG. 6 is a plan view of a segment of the lane showing the range finders.

Referring now specifically to the drawings, FIGS. 1–4 constitute a computer simulated showing of the cover layer and pattern, with the approach being on the left-hand side and the pin deck being on the right-hand side, while FIGS. 5, 6 and 7 depict the correct number of simulated boards across the width of the lane, without depicting the dark and light alternating board shades which exist, since it is believed the concept could be most clearly illustrated in this manner.

A bowling lane arrangement 10 in typical fashion includes the approach 12, an elongated lane 14, and a pin deck 16 on which the pins 18 are placed at the end of the lane. A foul line 20 is at the junction of lane 14 and approach 12. In usual fashion, a pair of gutters (not shown) straddle lane 14, a ball return track (not shown) extends the length of the lane, typically out of sight, and a pit (not shown) is located beyond the pin deck to receive the ball and struck pins. These conventional components are not shown in order to avoid confusion.

As depicted in FIGS. 5, 6 and 7, there are 39 simulated boards across the width of lane 14. In accordance with this invention, the simulated boards across the width of the lane cover layer have a sequence of successive alternating dark and light shades, typically of brown (dark shade) and yellowish tan (light shade), creating a distinct contrast between all of the simulated boards across the lane. The dark simulated boards preferably start at the outer edges, i.e., numbers 1 and 39. FIGS. 1–4 depict these contrasting boards. FIGS. 5–7 could be shaded to do this, but are left unshaded to assure understanding of the number of boards in the concept herein. The simulated wood is preferably that of maple.

In combination with this dark and light shading, the typical V pattern of range finders 22, seven in number, are located on boards, 5, 10, 15, 20, 25, 30 and 35 across the lane. The simulated boards containing the range finders 22 also contain what are commonly known in the trade as cherries 26, i.e., a pattern of dots (seven in number) across the width of the lane on the approach panel adjacent the foul line 20.

Only selected ones, but not all, of the simulated boards are outlined by dark board lines. These preferably are selected simulated boards on which the range finders are located, and most preferably only these simulated boards, are outlined by dark board lines, typically black, which simulate joints between these simulated boards and the adjacent simulated boards. These dark lines are shown at 28 in FIGS. 2–4, but are not depicted in FIGS. 5–7 to avoid confusion. The range finders are located in the first portion of the lane length from the foul line 20. In the second portion of the lane length from foul line 20, i.e., more than 20 feet from the foul line, are dark, elongated markings 30 and 32. These markings are preferably four in number, comprised of two pairs, preferably being substantially symmetrically arranged on certain ones of the selected simulated boards, most preferably those that contain the range finders. The first pair of dark elongated markings 30 depicted are on boards 15 and 25, while the second pair 32 are on boards 10 and 30. As depicted in FIG. 4, the first spaced pair preferably begins at about 34 feet from the foul line and preferably extends about 3 feet to about 37 feet from the foul line, while the second more widely spaced pair preferably begins at about 40 feet from the foul line and preferably extends about 3 feet to about 43 feet from the foul line.

It has been found that the special features noted, and especially the combination of features set forth, provide a unique perspective to the bowler to improve the game.

The above description is considered that of the preferred embodiment only. Modifications of the invention will occur to those skilled in the art and to those who make or use the invention. Therefore, it is understood that the embodiment shown in the drawings and described above is merely for illustrative purposes and not intended to limit the scope of the invention, which is defined by the following claims as interpreted according to the principles of patent law, including the doctrine of equivalents.

The invention claimed is:

1. A bowling lane surface having a width, first and second longitudinal portions, and two side edges, for a bowling lane having a foul line, comprising:

a top cover layer having a pattern of a plurality of elongated simulated boards side-by-side across the width of the lane cover layer, said cover layer having a symmetrical V pattern of spaced range finders on selected ones of said simulated boards, positioned uniformly across said lane cover layer on the first longitudinal portion of said lane cover layer;

said simulated boards across said lane cover layer being of alternate light and dark said selected simulated boards having said range finders thereon being outlined by dark shades;

said selected simulated boards having said range finders thereon being outlined by dark lines simulating joints between said simulated boards and the adjacent simulated boards; and a plurality of dark elongated markings arranged on certain ones of said selected simulated boards having said range finders thereon, said plurality of dark elongated markings being on the second longitudinal portion of said lane cover layer.

2. The bowling lane surface in claim 1 wherein said lane surface has 39 simulated boards across said lane surface, said selected simulated boards having said range finders thereon being simulated boards 5, 10, 15, 20, 25, 30 and 35, and said dark elongated markings being on simulated boards 10, 15, 25 and 30.

3. The bowling lane surface in claim 2 wherein said lane surface is 60 feet long from the foul line, and said dark elongated markings are at least about 20 feet from the foul line.

4. The bowling lane surface in claim 2 wherein said lane surface is 60 feet long from the foul line, and said dark elongated markings are at least about 34 feet from the foul line.

5. The bowling lane surface in claim 4 wherein there are a first two of said dark elongated markings beginning at about 34 feet from the foul line, and a second two dark elongated markings beginning at about 40 feet from the foul line.

6. The bowling lane surface in claim 5 wherein said first two dark elongated markings are on simulated boards 15 and 25, and said second two dark elongated markings are on simulated boards 10 and 30.

7. The bowling lane surface in claim 6 wherein said first pair of dark elongated markings extend about 3 feet, and said second pair of dark elongated markings extend about 3 feet.

8. The bowling lane surface cover in claim 7 wherein said lane cover has 39 simulated boards across said lane cover, said selected simulated boards having said range finders thereon being simulated boards 5, 10, 15, 20, 25, 30 and 35, and said dark elongated markings being on simulated boards 10, 15, 25 and 30.

9. The bowling lane surface in claim 1 wherein said dark lines simulating joints between simulated boards outline only said selected simulated boards having said range finders thereon.

10. A bowling lane surface having a width, first and second longitudinal portions, and two side edges, for a bowling lane having a foul line, comprising:

a top cover layer having a pattern of a plurality of elongated simulated boards side-by-side across the width of the lane cover layer, said cover layer having a pattern of spaced range finders on selected ones of said simulated boards, positioned uniformly across said lane surface on the first longitudinal portion of said lane cover layer;

said simulated boards across said lane cover layer being of alternate light and dark shades.

11. The bowling lane surface in claim 10 including 39 simulated boards.

12. The bowling lane surface in claim 10 wherein said dark simulated boards are at both said side edges.

13. The bowling lane surface in claim 10 wherein a plurality of dark elongated markings are substantially symmetrically arranged on certain ones of said selected simulated boards having said range finders thereon, said plurality of dark elongated markings being in the second longitudinal portion of said lane cover layer.

14. The bowling lane surface in claim 13 wherein said lane surface has 39 simulated boards across said lane surface, said selected simulated boards having said range finders thereon being simulated boards 5, 10, 15, 20, 25, 30 and 35, and said dark elongated markings being on simulated boards 10, 15, 25 and 30.

15. The bowling lane surface in claim 10 wherein said selected simulated boards having said range finders thereon are outlined by dark lines simulating joints between said simulated boards and the adjacent simulated boards.

16. The bowling lane surface cover in claim 10 wherein said lane cover is 60 feet long from the foul line, and said dark elongated markings are at least about 34 feet from the foul line.

17. The bowling lane surface cover in claim 16 wherein there are a first two of said dark elongated markings beginning at about 34 feet from the foul line, and a second two dark elongated markings beginning at about 40 feet from the foul line.

18. The bowling lane surface cover in claim 17 wherein said first two dark elongated markings are on simulated boards 15 and 25, and said second two dark elongated markings are on simulated boards 10 and 30.

19. The bowling lane surface cover in claim 18 wherein said first pair of dark elongated markings extend about 3 feet, and said second pair of dark elongated markings extend about 3 feet.

20. A bowling lane surface having a width, first and second longitudinal portions, a foul line, and two side edges, comprising:

a top cover layer having a pattern of a plurality of elongated simulated boards side-by-side across the width of said lane surface, said layer having a pattern of spaced range finders on selected ones of said simulated boards, positioned uniformly across said lane surface on the first longitudinal portion of said lane surface; and only selected ones, but not all of said selected simulated boards being outlined by dark lines simulating joints between said simulated boards and the adjacent simulated boards.

21. The bowling lane surface in claim 20 including dark markings symmetrically arranged on certain ones of said selected simulated boards, said dark elongated markings being in the second longitudinal portion of said lane surface.

22. The bowling lane surface in claim 21 wherein said bowling lane surface has 39 simulated boards across said lane surface, said selected simulated boards having said range finders thereon being simulated boards 5, 10, 15, 20, 25, 30 and 35, and said dark elongated markings being on simulated boards 10, 15, 25 and 30.

23. A bowling lane surface cover having a width, first and second longitudinal portions, and side edges, for a bowling lane having a foul line, comprising:

a cover layer having a pattern of a plurality of elongated simulated boards side-by-side across the width of the lane cover, said layer having a pattern of spaced range finders on selected ones of said simulated boards, positioned uniformly across said lane cover on the first longitudinal portion of said lane cover beyond the foul line toward said second longitudinal portion; and dark markings arranged on said simulated boards in the second longitudinal portion of said lane cover beyond said range finders.

24. The bowling lane surface cover in claim 18 wherein said dark markings are at least 20 feet from the foul line.

25. The bowling lane surface cover in claim 23 wherein said lane cover has 39 simulated boards across said lane cover, and said dark markings are elongated on a plurality of said simulated boards.

26. The bowling lane surface cover in claim 23 wherein said dark elongated markings are substantially symmetrically arranged a least about 34 feet from the foul line.

27. A bowling lane surface cover having a width, and first and second longitudinal halves, for a bowling lane having a foul line, comprising:

a cover layer having a pattern of a plurality of elongated simulated boards side-by-side across the width of the lane cover, said layer having a symmetrical V pattern of spaced range finders on selected ones of said simulated boards, positioned uniformly across said lane cover on the first longitudinal half of said lane cover;

said simulated boards across said lane cover being of alternate light and dark shades;

said selected simulated boards having said range finders thereon being outlined by dark lines simulating joints between said simulated boards and the adjacent simulated boards; and a plurality of dark elongated markings symmetrically arranged on certain ones of said selected simulated boards having said range finders thereon, said plurality of dark elongated markings being on the second longitudinal half of said lane cover.

28. The bowling lane surface cover in claim 27 wherein said dark lines simulating joints between simulated boards outline only said selected simulated boards having said range finders thereon.

29. The bowling lane surface cover in claim 23 wherein said cover extends 60 feet from the foul line, said first and second longitudinal portions comprise first and second longitudinal halves of said 60 foot cover, and said dark markings are elongated markings on said second longitudinal half of said cover.

30. The bowling lane surface cover in claim 29 wherein said dark elongated markings comprise a plurality of markings including an outer symmetric pair of markings extending further away from said first longitudinal half of said lane cover.

* * * * *

UNITED STATES PATENT AND TRADEMARK OFFICE

CERTIFICATE OF CORRECTION

PATENT NO.: 5,924,931
DATED : July 20, 1999
INVENTOR : William T. Morrissey, III It is certified that error appears in the above-identified patent and that said Letters Patent is hereby corrected as shown below:

Column 5, claim 24, line 20;

"claim 18" should be --claim 23--.

Column 5, claim 26, line 26;

"claim 23" should be --claim 24--.

Signed and Sealed this

Eighteenth Day of April, 2000

*Attest:*

Q. TODD DICKINSON

*Attesting Officer*

*Director of Patents and Trademarks*